United States Patent [19]

Herrin

[11] Patent Number: 4,846,775

[45] Date of Patent: Jul. 11, 1989

[54] METHOD FOR ASSEMBLING COMPOSITE CARTON BLANKS

[75] Inventor: Melvin B. Herrin, Meadowbrook, Pa.

[73] Assignee: Klearfold, Inc., Warrington, Pa.

[21] Appl. No.: 172,697

[22] Filed: Mar. 23, 1988

[51] Int. Cl.[4] ..... B31B 7/00

[52] U.S. Cl. ..... 493/95; 493/96; 493/334; 493/379; 493/905; 156/108

[58] Field of Search ..... 493/95, 96, 110, 114, 493/222, 334, 379, 905, 150; 156/108; 269/54.5

[56] References Cited

U.S. PATENT DOCUMENTS

| | | | |
|---|---|---|---|
| 648,639 | 5/1900 | Smith | 493/379 |
| 1,234,501 | 7/1917 | Smith | 493/222 |
| 2,338,189 | 1/1944 | Libbg et al. | 156/108 |
| 2,625,085 | 1/1953 | Bergstein | 493/150 |
| 3,209,661 | 10/1965 | Shubert | 493/114 |
| 4,498,878 | 2/1985 | Shieh | 441/80 |
| 4,506,442 | 3/1985 | Alzmann et al. | 269/54.5 |
| 4,518,379 | 5/1985 | Eldridge | 493/334 |
| 4,549,878 | 10/1985 | Herrin et al. | 493/334 |
| 4,664,648 | 5/1987 | Dupoy | 493/379 |

*Primary Examiner*—Frederick R. Schmidt
*Assistant Examiner*—Robert Showalter
*Attorney, Agent, or Firm*—Lerner, David, Littenberg, Krumholz & Mentlik

[57] ABSTRACT

A method for precision aligning of carton blanks having discrete fold lines in the manufacture of product display packages utilizes projecting alignment pins and transparent window blanks having laterally opposed notches. The alignment pins are arranged about the periphery of a carton blank having discrete fold lines and adjacent the inner edges of a formed opening for registration of the carton blank. The transparent window blank, having its pair of opposed notches in alignment with a fold line, is disposed in overlapping relationship over the opening of the carton blank, such that the alignment pins are received within the notches. The cooperation of the alignment pins and notches effectively provides precision alignment of the transparent window blank with the carton blank, for example, with respect to their fold lines and the like.

32 Claims, 3 Drawing Sheets

METHOD FOR ASSEMBLING COMPOSITE CARTON BLANKS

BACKGROUND OF THE INVENTION

The present invention relates in general to a method for assembling composite blanks and, more particularly, to a method for aligning together individual discrete fold lines within separate carton blanks which are to be joined together in overlapping relationship, to provide a transparent window and the like, by a suitable bonding agent provided therebetween.

The method of the present invention may be used to manufacture a variety of products, including containers, window-type display packages and a number of other items for which one piece of rigid or semi-rigid material need to attached to another. In the manufacture of storage and/or package-type containers, e.g., products display packages and the like, such containers are generally constructed from one or more blanks of suitable material folded into the appropriate shape of the desired container by an apparatus constructed for such purpose. Ultimately, such blanks are secured in their folded shape by a bonding agent provided along their mating portions. One such novel container is constructed, in part, from a transparent plastic blank. Such package provides the retailer with a number of advantages over conventional all-cardboard packages, for example, visual display of the product.

One form of such partially transparent package is constructed from a carton blank of paperboard, cardboard or the like, which may have printing and/or decorative material applied to either face thereof with information in regard to the product, instructions for use of the product, the application of a trademark associated with the product, etc. The carton blank is typically provided with an opening through which a portion of the contained product may be viewed by the potential customer for selection and inspection. The construction of such a partially transparent package initially requires that a transparent plastic blank be positioned overlying the opening within the cardboard blank and bonded along a portion thereof in overlapping edge relationship about the perimeter of the opening Prior to the bonding operation, however, the transparent plastic blank and cardboard blank must be appropriately positioned with respect to each other, for example, in registration with any fold lines, openings, printing and/or decoration thereon.

There has heretofore been generally unknown an economical apparatus which is suitably adapted to perform the function of aligning one blank overlying the opening within a second blank in the manner required in the construction of the above-noted packages. As to one known apparatus, such apparatus is constructed to include a supporting vacuum table and blank feed hoppers using suction grabbers. This apparatus, in addition to being expensive, is laborious and time consuming when required to change over the set-up from one package forming operation to another. Further, a blank positioned on a vacuum table is capable of being inadvertently shifted which would effect the precision alignment required when joining to a second blank. Other known apparatuses and methods, for example, as disclosed in U.S. Pat. Nos. 4,518,379 and 4,549,878 are generally concerned with the bonding of individual blanks together along their respective sides, as opposed to overlying an opening within one of the individual blanks.

There is known from U.S. Pat. No. 2,625,085 an apparatus and method for assembling composite containers of the knock-down or collapsible folding type. A panel blank of transparent material is supplied from a hopper and placed onto a moving platform carried along by a conveyor. A pair of locating fingers secured to the conveyor capture the leading edge of the panel blank to cause aligned placement of the panel blank on the platform between a plurality of alignment pins which are secured to the platform and conveyor. An adhesive applicator of the wheel or disk type applies a layer of suitable adhesive along the lateral top and side portions of the panel blank as the conveyor and platform move the panel blank into proper registration under the adhesive applicator. A pair of side forming blanks of paperboard or cardboard material are aligned overlapping the lateral top side portions of the transparent panel blanks via the pins extending through alignment apertures provided in the side forming blanks. The side forming blanks are accordingly bonded to the panel blank by the adhesive provided therebetween and by the compressive force applied to the overlapping portion by a pressing device constructed of a plurality of pressure bearing blocks secured to a moving chain aligned over the overlapping portion. The thus formed planar composite container can then be folded along its appropriate score lines into the final container shape.

The composite container assembly apparatus and method of the above-described prior art construction includes a number of notable disadvantages. For example, the side forming blanks are required to be provided with a plurality of apertures to effect the alignment of the side forming blanks with the panel blank via the alignment pins. The presence and location of such apertures is considered objectionable where they are readily visible in the assembled container by detracting from the container's asthetic appearance. In many cases, the apparatus described in the prior art is not adaptable to the joining of blanks of certain configurations. For example, the known apparatus and method requires that some portion of the side forming blank overlap the edge of the panel blank, thereby precluding the arrangement of one blank falling entirely within the surface area of the other blank with no edge overlap as required by containers as to be described herein which are provided with a transparent plastic window.

Accordingly, it can be appreciated that there is an unsolved need for a method for joining individual blanks together which is specifically adapted for joining one blank wholly overlying another blank so as to form, for example, a transparent window having accurately aligned fold lines in a cheap, continuous and rapid manner, and at a minimum of expense.

SUMMARY OF THE INVENTION

It is broadly an object of the present invention to provide a method for assembling composite carton blanks to provide a container having, for example, a transparent window, which overcomes or avoids one or more of the foregoing disadvantages resulting from the use of the above-mentioned composite container assembling apparatus and which fulfills the requirements of a method for manufacturing containers of the above-mentioned type in an accurate and uncomplicated manner.

Another object of the present invention is to provide a method for assembling composite carton blanks which is adapted for accurately aligning fold lines within respective carton blanks.

Another object of the present invention is to provide a method for assembling composite carton blanks in the manufacture of certain display packages having transparent windows and the like.

Another object of the present invention is to provide a method for assembling composite carton blanks wherein one blank forming a transparent window is arranged overlying an opening within the other blank and bonded along the peripheral edge defining the opening.

Another object of the present invention is to provide a method for assembling composite carton blanks which are of varied configuration.

Another object of the present invention is to provide a method for assembling composite carton blanks which avoids the necessity of using vacuum tables, while assuring alignment accuracy.

In accordance with one embodiment of the present invention, there is provided a method for assembling composite carton blanks comprising arranging a first blank having an upper surface overlying a support having a plurality of projecting elements positioned to extend upwardly adjacent the edges of the first blank, arranging a second blank overlying a portion of the upper surface of the first blank, one of the blanks having at least one notch formed along an edge thereof, receiving one of the elements within the notch for aligning the first blank with respect to the second blank, securing the first blank to the second blank about an overlapping portion thereof, and removing the joined first and second blanks from the support and the elements whereby an opening is provided by the notch adjacent an edge of one of the blanks.

In accordance with another embodiment of the present invention, there is provided a method for assembling composite carton blanks the method comprising arranging a first blank having an upper surface overlying a support having a plurality of projecting elements positioned to extend upwardly adjacent the edges of the first blank, the first blank including at least one first fold line, arranging a second blank having a designated portion for providing at least one second fold line overlying a portion of the upper surface of the first blank, one of the blanks having at least one notch formed along an edge thereof, receiving one of the elements within the notch for aligning the first fold line in colinear relationship with the designated portion for providing the second fold line, securing the first blank to the second blank about an overlapping portion thereof, and removing the joined first and second blanks from the support and the elements whereby an opening is provided by the notch between the first fold line and the designated portion for providing the second fold line adjacent an edge of one of the blanks.

In accordance with another embodiment of the present invention, there is provided a method for assembling composite carton blanks having discrete fold lines to be aligned, the method comprising arranging a first blank having an upper surface overlying a support having a plurality of projecting elements positioned to extend upwardly adjacent the edges of the first blank, the first blank including an opening therein and a pair of fold lines respectively arranged in colinear relationship on opposing sides of the opening, locating a pair of the elements opposing each other within the opening adjacent the edges of the first blank at the location of the pair of fold lines when the first blank is arranged overlying the support, having a pair of spaced-apart notches formed along opposing edges thereof overlying the upper surface of the first blank in registration with the opening, the second blank having at least one first fold line extending between the pair of notches, receiving the pair of elements within the pair of notches for aligning the pair of fold lines within the first blank in colinear relationship with the first fold line within the second blank, securing the first blank to the second blank about an overlapping portion thereof, and removing the joined first and second blanks from the support and the elements whereby an aperture is provided by the notches between the first fold line and a respective one of the pair of fold lines adjacent an edge of the first blank with the opening.

BRIEF DESCRIPTION OF THE DRAWINGS

The above description, as well as further objects, features and advantages of the present invention will be more fully understood with reference to th following detailed description of a presently preferred, but nonetheless illustrative; method for assembling composite carton blanks in accordance with the present invention, when taken in conjunction with the accompanying drawings wherein.

DETAILED DESCRIPTION

Figure 1:
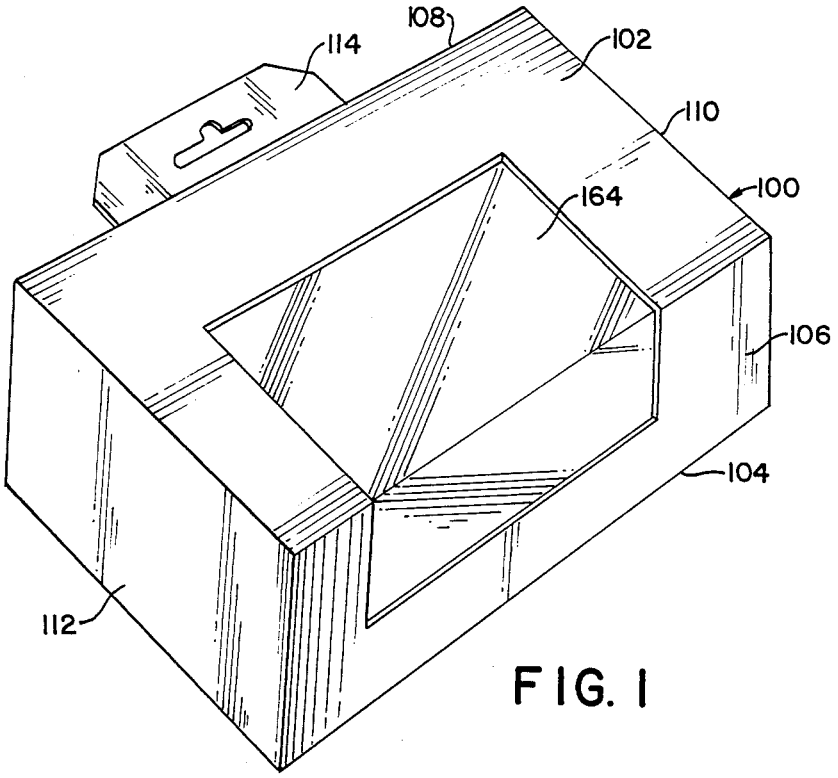
FIG. 1 is a perspective view of a product display package having a centrally disposed transparent window, which package has been assembled from composite carton blanks in accordance with the present invention.
Figure 2:
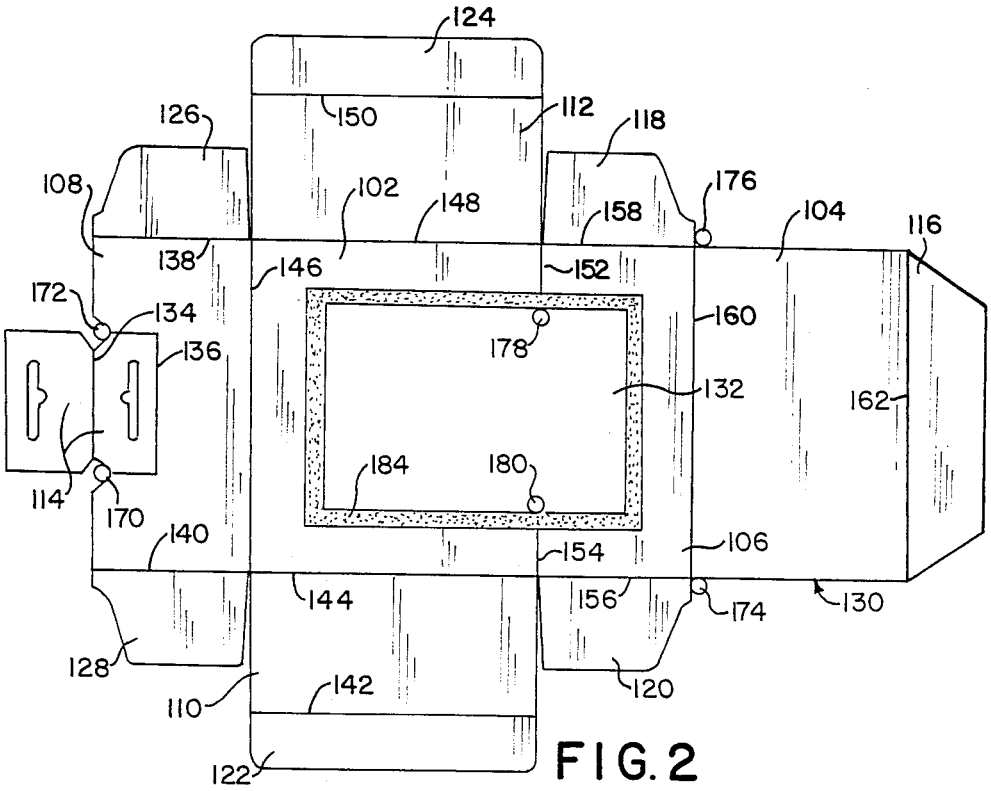
FIG. 2 is a top plan view of a carton blank having a centrally disposed opening, which blank is positioned on an underlying work table by a plurality of projecting pins.
Figure 3:
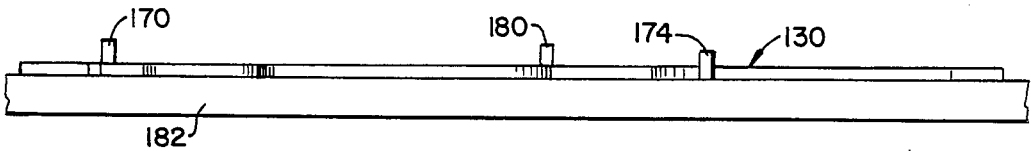
FIG. 3 is a side elevational view of the carton blank and supporting work table shown in FIG. 2.

Referring now to the drawings, wherein like reference numerals represent like elements, there is shown in FIG. 1 an assembled product display package generally designated by reference numeral 100. The product display package 100 is generally constructed to include a top panel 102, a bottom panel 104, a front panel 106, a rear panel 108, a right side panel 110, a left side panel 112, and a projecting package hanger 114. As shown in FIG. 2, the product display package 100 further includes a plurality of closure flaps 116, 118, 120, 122, 124, 126, 128.

The panels 102, 104, 106, 108, 110, 112, package hanger 114 and closure flaps 116, 118, 120, 122, 124, 126, 128 are defined from an integral single carton blank generally designated by reference numeral 130. In this regard, the carton blank 130 can be formed from paperboard, cardboard, plastic or the like. The carton blank 130 is further provided with a central rectangular opening 132 extending across the top panel 102 into a major portion of the front panel 106. A plurality of discrete fold lines 134, 136, 138, 140, 142, 144, 146, 148, 150, 152, 154, 156, 158, 160, 162 are arranged within the carton blank to allow its being folded into the product display package 100 as shown in FIG. 1. Although the carton blank 130 has been described as being of integral construction, it is to be understood that the carton blank may be formed from more than one blank joined together employing the apparatus disclosed in, for example, U.S. Pat. Nos. 4,518,379 and 4,498,878.

Figure 4:
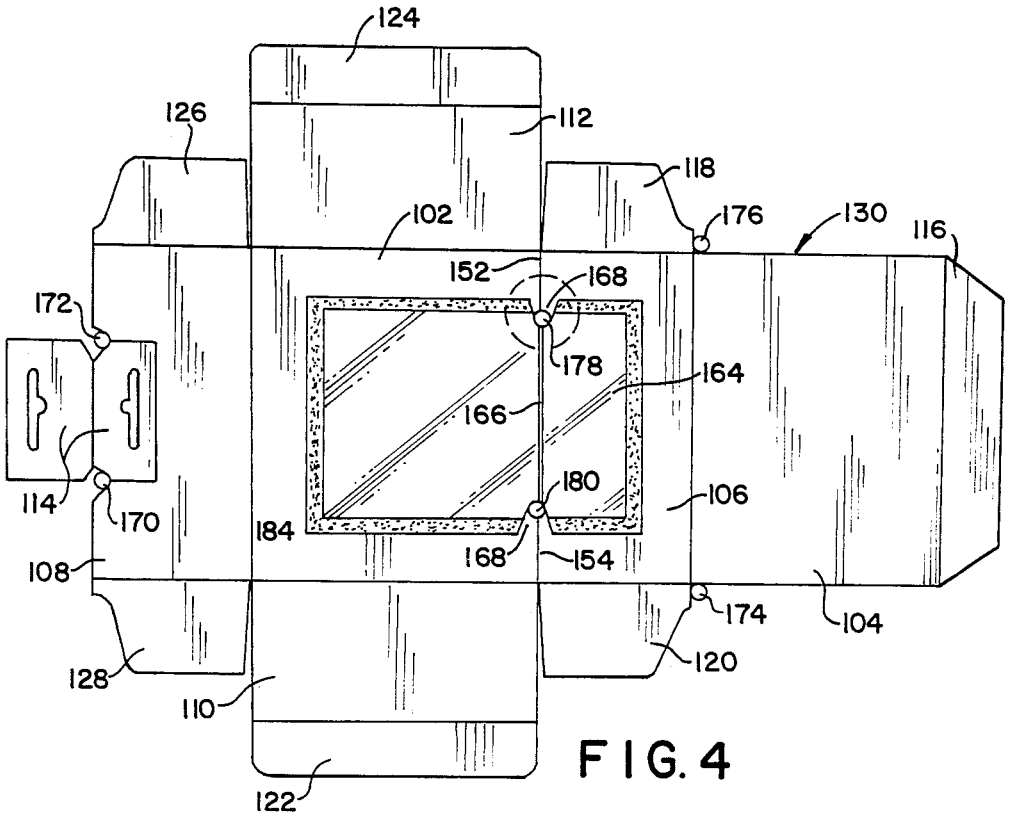
FIG. 4 is a top plan view of the carton blank shown in FIG. 2, further showing the precision alignment of fold lines within a transparent window blank with the fold lines within the underlying carton blank.
Figure 5:
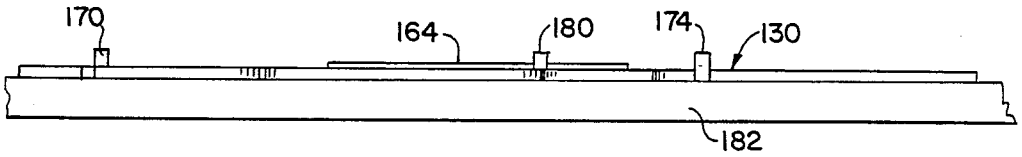
FIG. 5 is a side elevational view of the transparent window blank, underlying carton blank and work table shown in FIG. 4.
Figure 6:
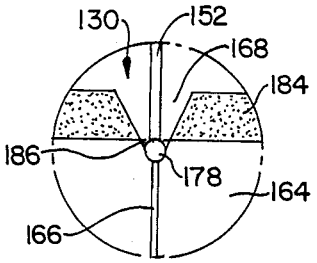
FIG. 6 is an enlarged plan view of that portion of FIG. 4 contained within the circularly arranged dashed lines.

Referring to FIGS. 1, 4 and 6, an integral rectangular window blank 164 is provided with a discrete fold line 166 extending between the narrow end portions of a pair of notches 168 which are formed along the opposed lateral edges of the window blank. The window blank 164 can be fabricated from transparent or semi-transparent, self-supporting plastic material to permit viewing of the contents within the product display package 100. However, it is to be understood that the window blank 164, as well as the carton blank 130, may be formed of other materials than those specified herein. In this regard, it is further to be noted that the carton blank 130 and window blank 164 may be so configured to construct product display packages of other designs than that shown in FIG. 1. In addition, the window blank 164 may be positioned within other panels of the product display package 100 other than that shown in FIG. 1.

Referring now to FIGS. 2–6, the method of the present invention for aligning and bonding the window blank 164 overlying the opening 132 within the carton blank 130 will now be described. A carton blank 130 is positioned overlying and supported by a work table 182 from which there upwardly extends a plurality of cylindrical alignment elements 170, 172, 174, 176, 178, 180 in the nature of pins or the like. The alignment elements are arranged about the peripheral edge of the carton blank 130 to maintain the carton blank at a fixed predetermined registered location with respect to the work table 182. As shown in FIG. 2, alignment elements 178, 180 are specifically arranged adjacent opposite edges of opening 132 at the terminal location of the fold lines 152, 154. The alignment elements 170, 172, 174, 176, 178, 180 are releasably secured to the work table 182 which may have a plurality of holes (not shown) for releasably receiving the alignment elements. In this manner, the alignment elements 170, 172, 174, 176, 178, 180 may be arranged in any desired configuration so as to accommodate a carton blank 130 of varying size and shape.

An adhesive layer 184 is now applied or previously pre-applied around the peripheral edge of the opening 130 by any suitable adhesive applicator. The window blank 164 is positioned overlying the opening 132 with its notches 168 in alignment with and receiving projecting alignment elements 178, 180. In this manner, the alignment elements 178, 180 by being received within the notches 168 of the window blank 164 affect the precision alignment of fold line 166 of the window blank with the spaced-apart fold lines 152, 154 of the carton blank 130. Upon application of suitable pressure about the periphery of the window blank 164, the window blank is adhered to the carton blank 130 via the adhesive layer 184. Alternatively, the adhesive layer 184 may be applied or pre-applied to the carton blank 130, or window blank 164. The adhesive layer 184 may be in the nature of a heat seal adhesive activated by heat and bonded using pressure. Further, bonding of the carton blank 130 to the window blank 164 may be achieved without an adhesive layer 184 by selection of certain plastics for the window blank which will adhere to the carton blank upon application of heat and pressure. The positioning of the carton blank 130 and window blank 164 may be achieved either manually or through automated equipment for handling and transporting individual blanks, for example, the blank feeding device disclosed in U.S. Pat. No. 4,518,379.

Figure 6A:
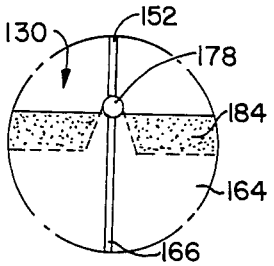
FIG. 6A is another embodiment of that portion of FIG. 4, contained within the circularly arranged dashed lines.

In addition to the notches 168 of the window blank 164 cooperating with the alignment elements 178, 180 for registration purposes, the notches have an additional function which enhances the foldability of the product display package 100. As shown in FIG. 6, a peripheral portion of the window blank 164 overlaps a peripheral portion of the carton blank 130 which defines the opening 132. In the absence of the notches 168, it was previously known from U.S. Pat. No. 4,664,648, that the peripheral portion of the window blank 164 would be bonded overlying a portion of the fold lines 152, 154 within the carton blank 130. Upon folding of the product display package 100, there would be a double thickness of material resulting from the folded peripheral portion of the window blank 164. This double thickness of material will inhibit proper folding of the product display package 100. Thus, to enhance the foldability of the product display package 100 in the vicinity of fold lines 152, 154, notches 168 have been provided. In addition, the notches 168 could be formed in the carton blank 130 at the inner edges of fold lines 152, 154 to achieve the same result, as shown in FIG. 6A. Alignment elements 178, 180 in addition to effecting precision alignment of fold lines 152, 154 with fold line 166, and registration of window blank 164 with opening 132, ensures that no portion of the window blank will overlap fold lines 152, 154 within the carton blank 130 by providing a positive opening 186 therebetween. In other words, the terminal narrow end portions of notches 168 are spaced from the lateral edges of opening 132 by a predetermined distance generally corresponding to the diameter of alignment elements 178, 180. The resulting openings 186 ensure easy foldability of the product display package 100.

Although the window blank 164 has been described as having a preformed fold line 166, it is to be understood that the fold line 166 may be formed in the window blank either simultaneously with or subsequent to its bonding to the carton blank 130. In addition, it is also contemplated that the window blank 164 may require precision alignment with the carton blank 130 for reasons other than alignment of the fold line 166 with fold lines 152, 154. For example, where the carton blank 130 and window blank 164 have predetermined printing to be aligned or where the window blank has a unique shape making it difficult to align properly with a corresponding shaped opening 132 within the carton blank 130. Still further, it is contemplated that the method of the present invention may be utilized to align a second blank, for example, of paperboard, cardboard or the like to the carton blank 130, as opposed to a transparent window blank 164. This is specifically useful when the carton blank 130 is generic, while the second blank to be adhered overlying the window 132 will have specific information with respect to the contained product, for example, particular instructions, model number, color, etc. Still further, it is contemplated that the window blank 164 may be first placed on the work table 182 and the carton blank 130 arranged overlying therewith.

Figure 7:
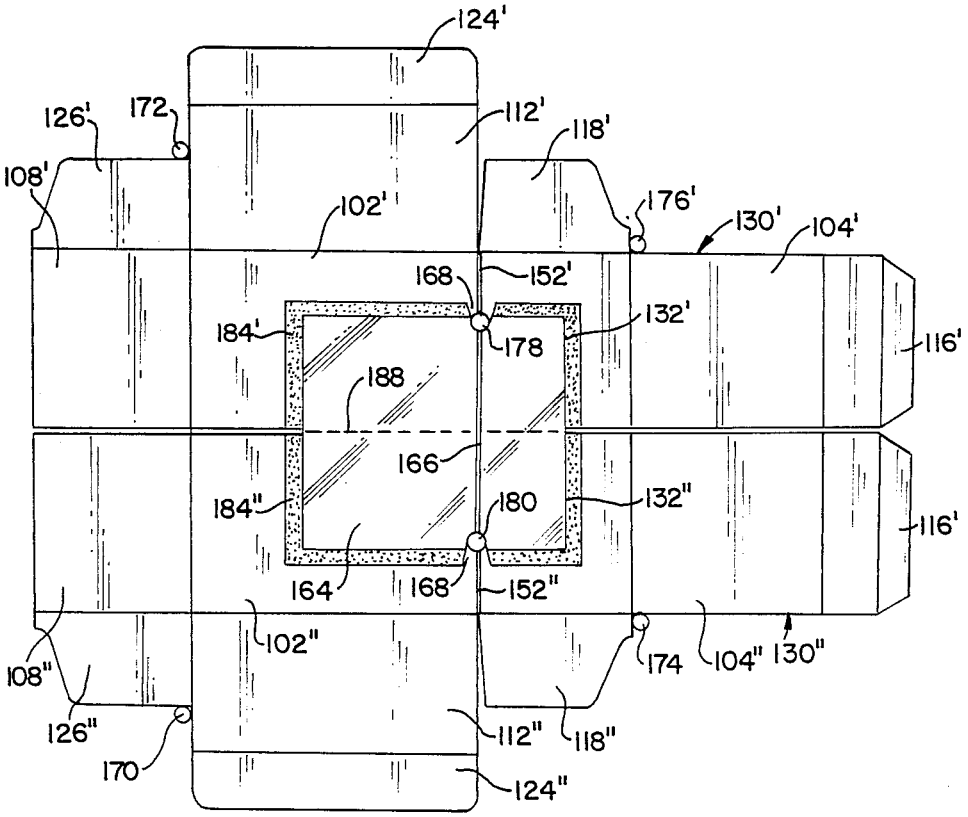
FIG. 7 is a top plan view of the arrangement of a double carton blank and single transparent window blank in accordance with another embodiment of the present invention.

Referring now to FIG. 7, the method of the present invention is utilized to form a modified form of a product display package which is provided with an open side. In this regard, a pair of carton blanks 130', 130'', each capable of being formed into an individual product display package, are provided in side by side aligned relationship by means of alignment elements 170, 172, 174, 176, 178, 180, as previously described. A single transparent window blank 164 is sized to be positioned overlying side openings 132', 132'' within the adjacent carton blanks 130', 130''. The window blank 164 has its fold line 166 aligned with fold lines 152', 152'' via the alignment elements 178, 180 being received within the notches 168, as previously described. Upon securing the window blank 164 to the carton blanks 130', 130'' via adhesive layers 184', 184'', the resulting composite carton blanks may be severed along dotted line 188 by simple means (not shown), for example, by a cutting wheel and the like. Upon severing carton blank 130' from carton blank 130'', each carton blank may be formed into an appropriate product display package by folding and the like.

Although the invention herein has been described with reference to particular embodiments, it is to be understood that these embodiments are merely illustrative of the principles and application of the present invention. Accordingly, it is therefore to be understood that numerous modifications may be made to the illustrative embodiments and that other arrangements may be devised without departing from the spirit and scope of the present invention as defined by the appended claims

What is claimed is:

1. A method for assembling composite carton blanks comprising arranging a first blank having an upper surface overlying a support having a plurality of projecting elements positioned to extend upwardly adjacent the edges of said first blank, arranging a second blank overlying a portion of said upper surface of said first blank, one of the blanks having at least one notch opening along an edge thereof, the other of the blanks having an opening therein, receiving one of said elements within said notch of said one blank and adjacent at least one inner edge of the other blank forming said opening therein for aligning said first blank with respect to said second blank, a portion of said notch in said one blank overlapping a portion of said other blank, securing said first blank to said second blank about an overlapping portion thereof, and removing the joined first and second blanks from said support and said elements, whereby an opening is provided by said notch within said one blank and along said one edge of said other blank.

2. The method of claim 1, wherein said first blank includes said opening therein, and locating a pair of elements opposing each other adjacent the inner edges of said first blank forming said opening when said first blank is arranged overlying said support.

3. The method of claim 2, wherein said second blank includes a pair of notches formed along opposing outer edges of said second blank, and arranging said second blank overlying said opening with said pair of elements respectively received within said pair of notches.

4. The method of claim 3, wherein said second blank includes a first fold line extending between said pair of notches, and arranging said first fold line extending between said pair of elements when said second blank is positioned overlying said opening.

5. The method of claim 4, wherein said first blank includes a second fold line and a third fold line respectively arranged in colinear relationship on opposing sides of said opening, and arranging said second fold and said third fold line in colinear relationship with said first fold line of said second blank when positioning said second blank in registration with said opening by means of said pair of elements being received within said pair of notches.

6. The method of claim 2, further including arranging other than said pair of elements about the exterior edges of said first blank, whereby said first blank is maintained overlying said support between said elements

7. The method of claim 1, wherein said first blank is constructed of paperboard or cardboard material.

8. The method of claim 1, wherein said second blank is constructed of paperboard or cardboard material.

9. The method of claim 1, wherein said first blank is constructed of rigid or semi-rigid, self-supporting plastic material

10. The method of claim 9, wherein said plastic material is transparent.

11. The method of claim 1, wherein said second blank is constructed of rigid or semi-rigid, self-supporting plastic material

12. The method of claim 1, wherein said first blank includes a pair of notches

13. The method of claim 12, wherein said second blank includes said opening therein, and locating a pair of elements opposing each other within said pair of notches and adjacent the inner edges of said second blank forming said opening therein when said second blank is arranged overlying said first blank on said support.

14. A method for assembling composite carton blanks, said method comprising arranging a first blank having an upper surface overlying a support having a plurality of projecting elements positioned to extend upwardly adjacent the edges of said first blank, said first blank including at least one first fold line, arranging a second blank having a designated portion for providing at least one second fold line overlying a portion of said upper surface of said first blank, one of the blanks having a least one notch opening along an edge thereof, receiving one of said elements within said notch for aligning said first fold line in colinear relationship with said designated portion for providing said second fold line, securing said first blank to said second blank about an overlapping portion thereof, and removing the joined first and second blanks from said support and said elements, whereby an opening is provided by said notch within said one of the blanks adjacent and edge of the other blank and between said first fold line and said designated portion for providing said second fold line thereat.

15. The method as set forth in claim 14, wherein said first blank includes an opening therein, and locating a pair of elements opposing each other adjacent the inner edges of said first blank forming said opening when said first blank is arranged overlying said support.

16. The method of claim 15, wherein said second blank includes a pair of notches formed along opposing outer edges of said second blank, and arranging said second blank overlying said opening with said pair of elements respectively received within said pair of notches.

17. The method of claim 16, wherein said designated portion extends between said pair of notches, and arranging said designated portion extending between said pair of elements when said second blank is positioned overlying said opening.

18. The method of claim 17, wherein said first blank includes a third fold line arranged in colinear relationship with said first fold line, said first fold line and said second fold line provided on opposing sides of said opening, and arranging said first fold line and said third fold line in colinear relationship with said designated portion for providing said second fold line of said second blank when positioning said second blank overlying said opening by means of said pair of elements being received within said pair of notches.

19. The method of claim 15, further including arranging other than said pair of elements about the exterior edges of said first blank, whereby said first blank is maintained overlying said support between said elements.

20. The method of claim 14, wherein said first blank is constructed of paperboard or cardboard material.

21. The method of claim 14, wherein said second blank is constructed of paperboard or cardboard material.

22. The method of claim 14, wherein said first blank is constructed of rigid or semi-rigid, self-supporting plastic material.

23. The method of claim 22, wherein said plastic material is transparent.

24. The method of claim 14, wherein said second blank is constructed of rigid or semi-rigid, self-supporting plastic material.

25. The method of claim 14, wherein said first blank includes a pair of notches.

26. The method of claim 25, wherein said second blank includes an opening therein, and locating a pair of elements opposing each other within said pair of notches and adjacent the inner edges of said second blank forming said opening therein when said second blank is arranged overlying said first blank on said support.

27. A method for assembling composite carton blanks having discrete fold lines to be aligned, said method comprising arranging a first blank having an upper surface overlying a support having a plurality of projecting elements positioned to extend upwardly adjacent the edges of said first blank, said first blank including an opening therein and a pair of fold lines respectively arranged in colinear relationship on opposing sides of said opening, locating a pair of said elements opposing each other within said opening adjacent the edges of said first blank at the location of said pair of fold lines when said first blank is arranged overlying said support, arranging a second blank having a pair of spaced-apart notches formed along opposing edges thereof overlying said upper surface of said first blank in registration with said opening, said second blank having at least one first fold line extending between said pair of notches, receiving said pair of elements within said pair of notches for aligning said pair of fold lines within said first blank in colinear relationship with said first fold line within said second blank, securing said first blank to said second blank about an overlapping portion thereof, and removing the joined first and second blanks from said support and said elements whereby an aperture is provided by said notches between said first fold line and a respective one of said pair of fold lines adjacent an edge of said first blank with said opening.

28. The method of claim 27, wherein said second blank is constructed of rigid or semi-rigid, self-supporting plastic material.

29. A method for assembling composite carton blanks comprising arranging a first blank having an upper surface overlying a support having a plurality of projecting elements positioned to extend upwardly adjacent the edges of said first blank, said first blank including an opening therein, locating a pair of elements opposing each other adjacent the inner edges of said first blank forming said opening therein when said first blank is arranged overlying said support, arranging a second blank overlying a portion of said upper surface of said first blank, said second blank including a pair of notches formed along opposing outer edges of said second blank, arranging said second blank overlying said opening of said first blank with said pair of elements respectively received within said pair of notches for aligning said first blank with respect to said second blank, said second blank including a first fold line extending between said pair of notches, arranging said first fold line extending between said pair of elements when said second blank is positioned overlying said opening, securing said first blank to said second blank about an overlapping portion thereof, and removing the joined first and second blanks from said support and said elements whereby an opening is provided by said notch adjacent an edge of one of the blanks.

30. A method for assembling composite carton blanks, said method comprising arranging a first blank having an upper surface overlying a support having a plurality of projecting elements positioned to extend upwardly adjacent the edges of said first blank, said first blank including an opening therein, locating a pair of elements opposing each other adjacent the inner edges of said first blank forming said opening when said first blank is arranged overlying said support, said first blank including at least one first fold line, arranging a second blank having a designated portion for providing at least one second fold line overlying a portion of said upper surface of said first blank, one of the blanks having at least one notch formed along an edge thereof, receiving one of said elements within said notch for aligning said first fold line in colinear relationship with said designated portion for providing said second fold line, securing said first blank to said second blank about an overlapping portion thereof, and removing the joined first and second blanks from said support and said elements whereby an opening is provided by said notch between said first fold line and said designated portion for providing said second fold line adjacent an edge of one of the blanks.

31. The method of claim 14, further including arranged said notch in said one of the blanks overlapping a portion of the other blank.

32. The method of claim 14, further including providing said second fold line within said designated portion of said first blank.

* * * * *